US009067648B2

(12) United States Patent
Carcone et al.

(10) Patent No.: US 9,067,648 B2
(45) Date of Patent: Jun. 30, 2015

(54) UNMANNED UNDERWATER VEHICLE LAUNCHER

(75) Inventors: John Carcone, Portsmouth, RI (US); Domenic F. Napolitano, Barrington, RI (US)

(73) Assignee: Raytheon Company, Waltham, MA (US)

( * ) Notice: Subject to any disclaimer, the term of this patent is extended or adjusted under 35 U.S.C. 154(b) by 269 days.

(21) Appl. No.: 13/604,053

(22) Filed: Sep. 5, 2012

(65) Prior Publication Data

US 2014/0060417 A1 Mar. 6, 2014

(51) Int. Cl.
*B63G 8/00* (2006.01)
*B63B 27/36* (2006.01)
*B63G 8/42* (2006.01)

(52) U.S. Cl.
CPC ..... *B63B 27/36* (2013.01); *B63G 8/001* (2013.01); *B63G 8/42* (2013.01)

(58) Field of Classification Search
CPC ..... B63G 8/001; B63B 22/003
USPC ..... 114/312; 89/1.812
See application file for complete search history.

(56) References Cited

U.S. PATENT DOCUMENTS 7,699,015 B1 4/2010 Said
7,712,429 B1 * 5/2010 Gibson et al. ..... 114/312
2009/0151617 A1 6/2009 Lambertus
2010/0018449 A1 1/2010 Luccioni et al.
2012/0192780 A1 8/2012 Soreau et al.

FOREIGN PATENT DOCUMENTS

EP 2 468 621 A1 6/2012

OTHER PUBLICATIONS

Airborne Mine Neutralization System (AMNS); Navy Programs; 2004; 2 pages; http://www.dote.osd.mil/pub/reports/FY2004/pdf/navy/2004AMNS.pdf; Office of the Secretary of Defense.
Beaudry; "Raytheon Awarded $14 Million for Airborne Mine Neutralization System"; CNN Money; Oct. 7, 2010; 2 pages; http://money.cnn.com/news/newsfeeds/articles/prnewswire/NE77827.htm published online; CNN.
PCT application PCT/US2013/058279; filed Sep. 5, 2013; Raytheon Company; International Search Report dated Nov. 25, 2013.

* cited by examiner

*Primary Examiner* — Edwin Swineheart

(57) ABSTRACT

An unmanned underwater vehicle (UUV) shipboard launcher system, which comprises a deployment device and an unmanned underwater vehicle (UUV) launcher. The UUV launcher includes a frame, a canister coupler to facilitate coupling of a communication line canister of a UUV to the launcher, and a UUV coupling device supported about the frame to releasably secure the UUV to the launcher. The UUV launcher also includes an arming pin engagement feature supported about the frame, and operable to engage an arming pin of the UUV upon being secured to the launcher, as well as a separation device supported about the frame and adapted to force the UUV away from the UUV launcher upon release of the UUV by the UUV coupling device, which separation may function to remove the arming pin and arm the UUV.

20 Claims, 5 Drawing Sheets

UNMANNED UNDERWATER VEHICLE LAUNCHER

BACKGROUND

Underwater naval mines are a constant threat to surface ships and submarines. Unmanned underwater vehicles (UUVs) are commonly used to neutralize naval mines. One such UUV is the Archerfish. The Archerfish is powered by two mid-body propellers allowing for flexible operation in fast transit mode to the target and hover mode during identification and destruction of the target. The Archerfish stays connected to its parent ship through a fiber-optic link receiving guidance inputs from the ship's sonar system. Target acquisition uses the UUV's short range sonar and video camera generating imagery for a correct inspection and identification by the remote operator. Maneuverability of the UUV also allows for imagery from a variety of angles. The UUV neutralizes the target by detonating its shaped charge warhead.

UUVs, such as the Archerfish, are typically deployed from a helicopter. Current helicopter based deployment systems, however, are extremely complicated and include gears, screws, switches, and an electronic control system, which are prone to corrosion and failure. In addition, the helicopter based systems are expensive to build and operate.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
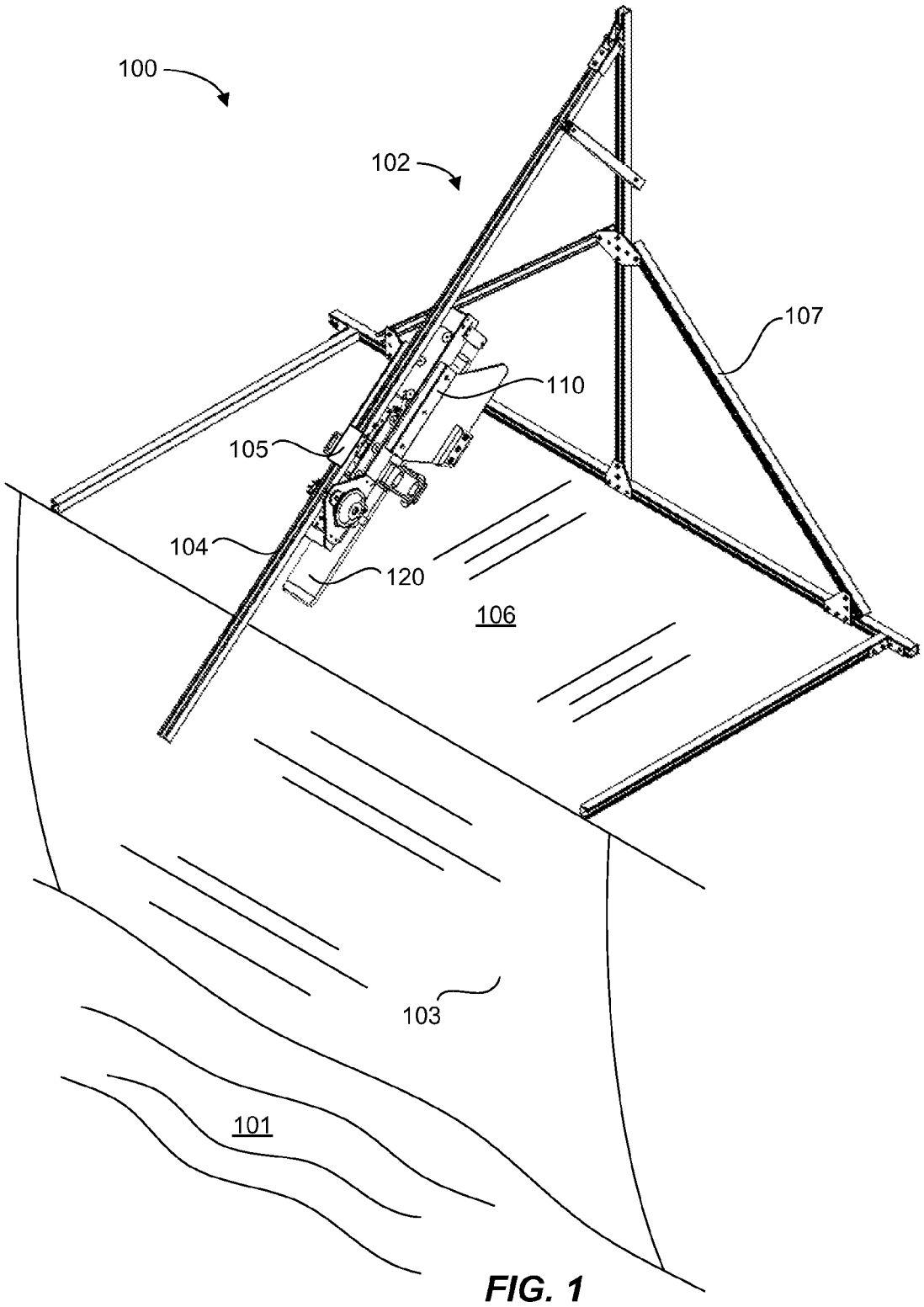
FIG. 1 is an example illustration of a UUV shipboard launcher system in accordance with an embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

As indicated above, UUVs, such as the Archerfish, are typically deployed from a helicopter, which can be problematic. For these and other reasons, it can be desirable to deploy a UUV from a surface ship.

Accordingly, a UUV launcher is disclosed that enables deployment of a UUV from a surface ship. In one aspect, an arming pin for a warhead of the UUV is automatically pulled once the UUV has arrived at a predetermined depth in the water. The UUV launcher can include a frame, a canister coupler to facilitate coupling of a communication line canister of a UUV to the launcher, and a UUV coupling device supported about the frame to releasably secure the UUV to the launcher. The UUV launcher can also include an arming pin engagement feature supported about the frame, and operable to engage an arming pin of the UUV upon being secured to the launcher, and to effectively pull the arming pin from the UUV to arm the UUV. In addition, the UUV launcher can include a separation device supported about the frame and adapted to force the UUV away from the UUV launcher upon release of the UUV by the UUV coupling device. The arming pin can be removed from the UUV upon separation.

A UUV shipboard launcher system is also disclosed. In one aspect, the launcher system can deploy the UUV with an initial path that is directed away from the ship. The system can include a UUV, a UUV launcher in support of the UUV, and a deployment device disposed on a ship, and configured to facilitate shipboard deployment of the launcher and the UUV, the UUV launcher being releasably engageable with the deployment device. The launcher system can strategically deploy the UUV launcher and the UUV into a body of water for subsequent separation and operation of the UUV.

Figure 2:
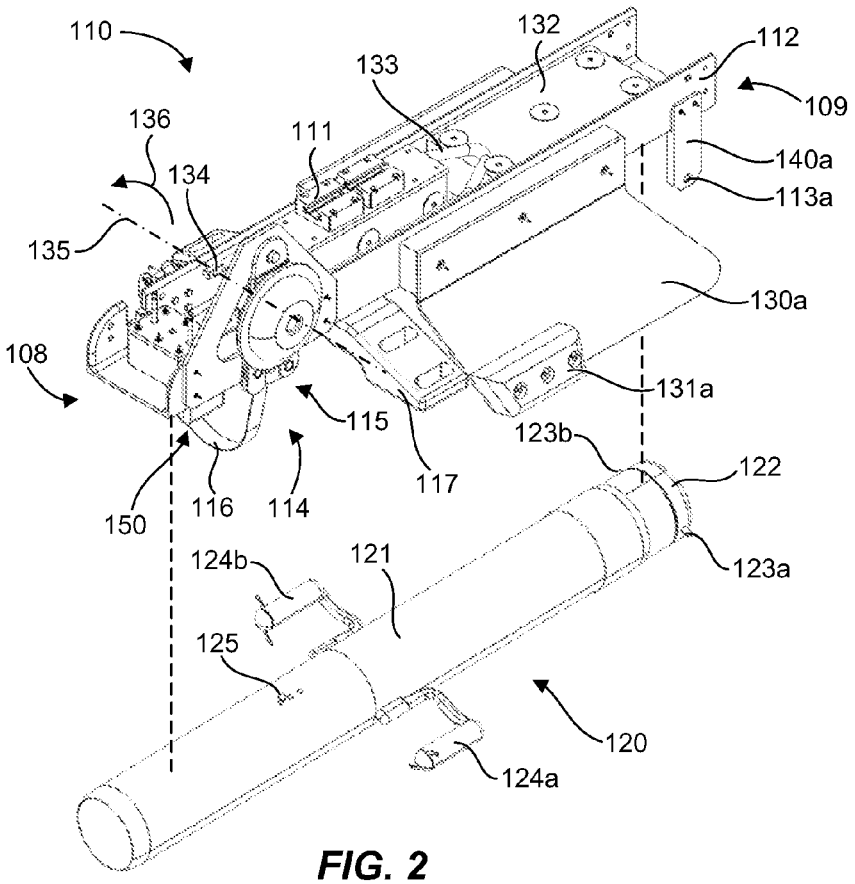
FIG. 2 is a top front perspective view of a UUV launcher and UUV in accordance with an embodiment of the present invention.

One embodiment of a UUV shipboard launcher system 100 is illustrated in FIG. 1. The system 100 can comprise a UUV 120, a UUV launcher 110 in support of the UUV 120, and a deployment device 102 disposed on or about a ship 103, such as the deck of a ship. Additional detail of the UUV 120 and the UUV launcher 110 is shown in FIG. 2. The deployment device 102 can be configured to facilitate shipboard deployment of the UUV launcher 110 and the UUV 120. By shipboard it is meant that the UUV launcher 110 and the associated UUV 120 can be deployed from the surface or other area of a ship. The UUV launcher 110 can be releasably engageable with the deployment device 102 so that the launcher system 100 can strategically deploy the UUV launcher 110 and the UUV 120 into a body of water 101 for subsequent separation and operation of the UUV 120. The disclosed system 100 can be a portable, complete, and stand-alone system with its own UUV control system. In one aspect, the system can be powered by a portable generator or battery, or by the ship's power.

As illustrated in FIGS. 1 and 2, the deployment device 102 can include a rail 104 configured to receive and engage an engagement member 111 of the UUV launcher 110. The engagement member 111 can be adapted to facilitate releasable coupling of the launcher 110 to the deployment device 102. The UUV launcher 110 can be slideable along the rail 104 and releasable from an end of the rail 104, wherein it may be directed into the water 101. The engagement member 111 can include a slot, channel, groove, etc. for slidably interfacing with the rail 104. The system 100 can also include a triggering mechanism 105 that can initiate deployment of the launcher 110 from the deployment device 102. The triggering mechanism 105 can comprise a releasable mechanical latch, an electromechanical release, such as a solenoid-based release, or any other release mechanism. Thus, when released for deployment by the triggering mechanism 105, the UUV launcher 110 can slide along the rail 104 and continue in motion off the end of the rail and into a free fall, landing in the body of water 101. The rail 104 of the deployment device 102 can therefore be used to strategically deploy the UUV launcher 110 and attached UUV 120 into the water 101.

Strategic deployment can encompass a correct or optimal speed, attitude, and/or direction of the launcher 110 (and coupled UUV) into the water, which can be accomplished by an angle of the rail 104, a length of the rail 104, an orientation of the rail 104, etc. For example, the UUV launcher 110 can be strategically deployed ensure that the path of travel of the UUV 120 will be initially directed away from the ship 103, such as by orienting the rail 104 in a plane that is perpendicular to the hull of the ship 103 proximate to the location of the shipboard launcher system 100. In one aspect, the position and orientation of the rail 104 can be adjustable.

To support the rail 104 about a deck 106 of the ship 103, the deployment device 102 can also include a support structure 107. The support structure 107 can be configured to be secured to a part of the ship 103, such as the deck 106, a railing, and/or a life line stanchion. The support structure 107 can be readily adapted to interface with any platform and can be installed on any ship without requiring special equipment. In one aspect, the support structure 107 can be adjustable to alter the position and/or orientation of the rail 104.

With further reference to FIG. 2, the UUV 120 can be fitted with a communication line canister 122. Upon deployment, the UUV 120 can separate from the canister 122 but remain connected via a communication line, such as a fiber optic line, that is coiled or otherwise disposed inside the canister 122. The canister 122 can be coupled to the launcher 110 via coupling features 123*a*, 123*b* and can remain with the launcher 110 after the UUV 120 is separated and deployed from the launcher 110. As the UUV 120 becomes farther removed from the canister 122, the communication line is uncoiled and paid out from the canister 122 to maintain a communication connection between the UUV 120 and the canister 122 (and ultimately, the ship) to enable control of the UUV 120.

As shown in FIGS. 2-4C, to interface with the UUV 120 and support the UUV 120 for deployment, the UUV launcher 110 can include a frame 112, a canister coupler 113*a*, 113*b*, and a UUV coupling device 114. In general, the frame 112 can provide a primary support for the various components of the launcher 110. For example, at a rearward end 109 of the launcher 110, frame 112 can support the canister coupler 113*a*, 113*b* that can facilitate coupling of the communication line canister 122 of the UUV 120 to the UUV launcher 110. The canister coupler 113 can be positioned by an extension arm 140*a*, 140*b*, which can be separate from or integral with the frame 112. The position of the canister coupler 113 can be configured to allow rotation of the canister 122, without interference with the launcher 110, about the canister coupler 113*a*, 113*b* in response to forces applied by the communication line as the line is paid out. Unhindered rotation of the canister 122 relative to the launcher 110 can facilitate successful uncoiling and distribution of the communication line without binding or kinking as the line is removed from the canister 122. For example, after the UUV 120 has been deployed, the canister 122 can be oriented in a generally downward direction to clear the communication line from potential snag points and prevent fouling of the communication line.

In addition, the UUV coupling device 114 can be supported about the frame 112 to releasably secure the UUV 120 to the UUV launcher 110 prior to deployment of the UUV 120. In one aspect, the UUV coupling device 114 can comprise a hydrostatic release latch 115 and a restraining strap 116. One end of the strap 116 can be secured by a ratcheting and/or tightening mechanism 118 (shown in FIG. 4C) and the opposite end of the strap 116 can be wrapped around the UUV 120 and secured by the hydrostatic release latch 115. The strap 116 can be selectively releasable by the hydrostatic release latch 115 at a predetermined depth below the water surface, such as about 10 feet below the surface, in order to separate the UUV 120 from the launcher 110.

Figure 3:
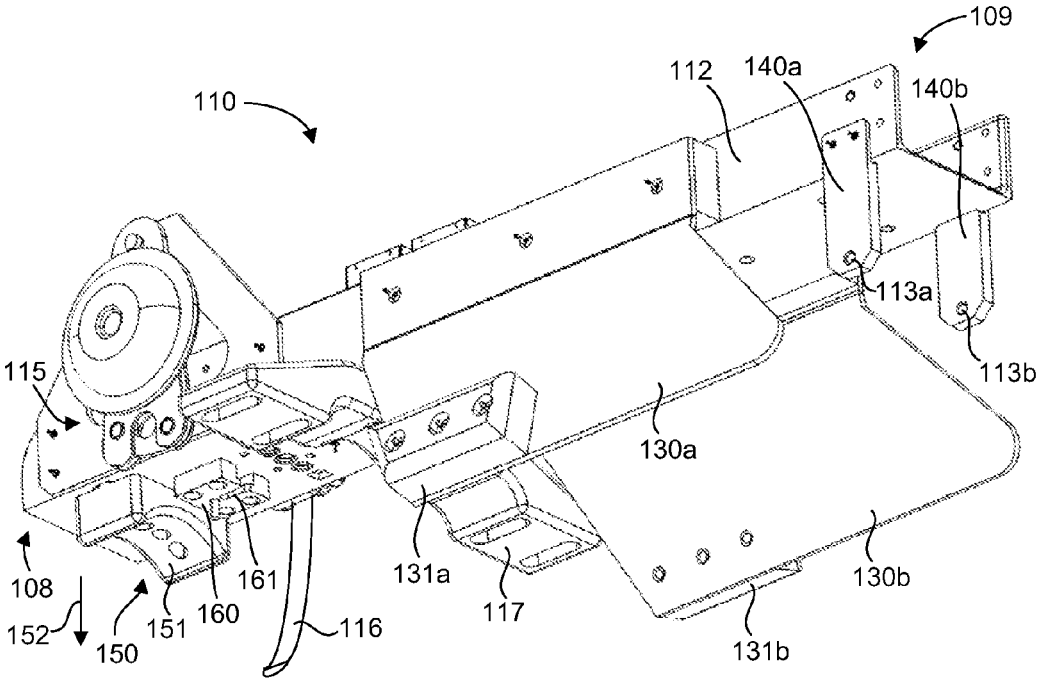
FIG. 3 is a bottom rear perspective view of the UUV launcher of FIG. 2.
Figure 4A:
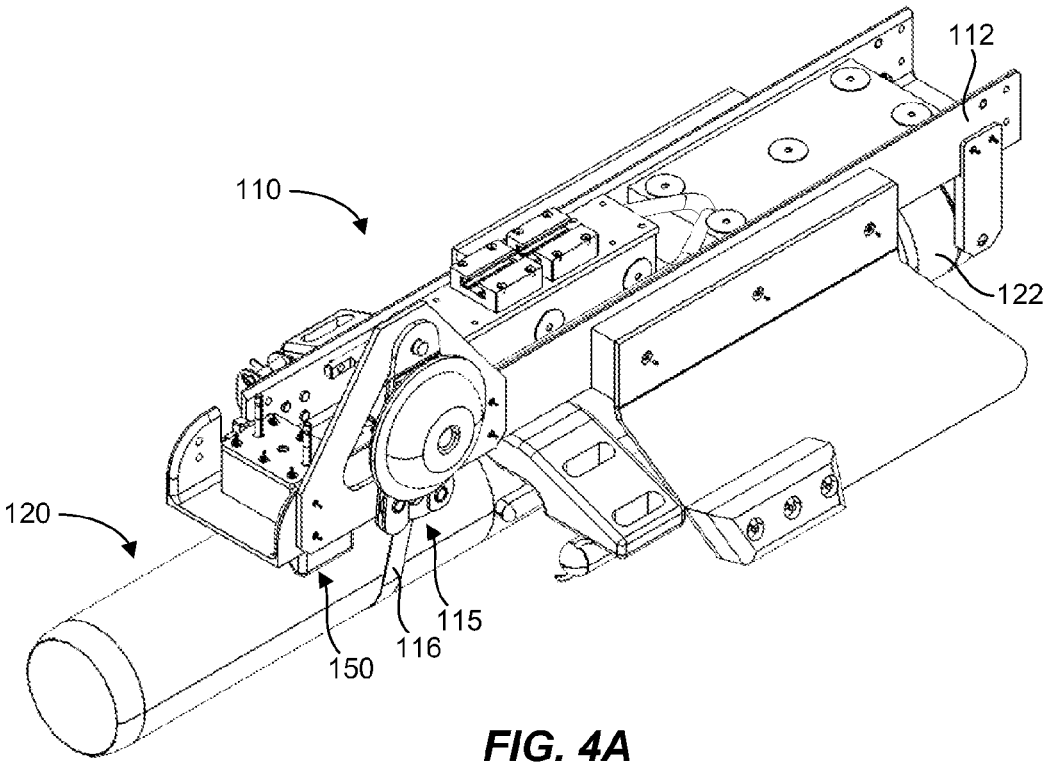
FIG. 4A is a top front perspective view of the UUV attached to the UUV launcher of FIG. 2.
Figure 4B:
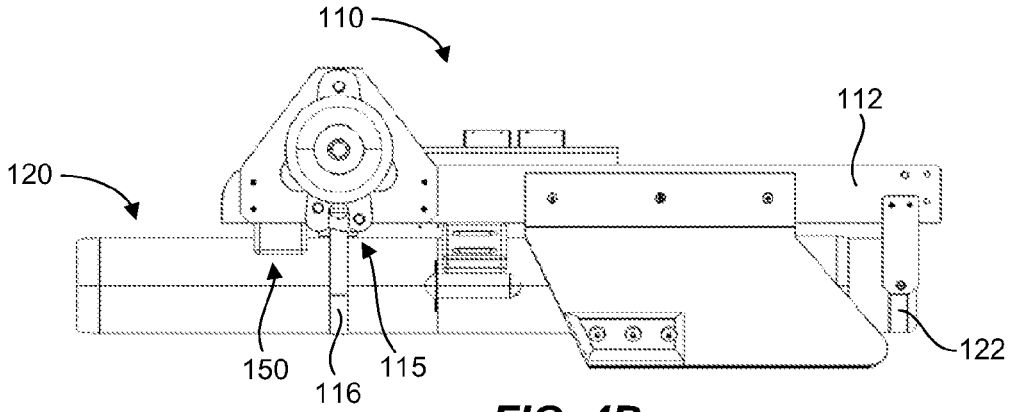
FIG. 4B is a side view of the UUV launcher and attached UUV of FIG. 4A.
Figure 4C:
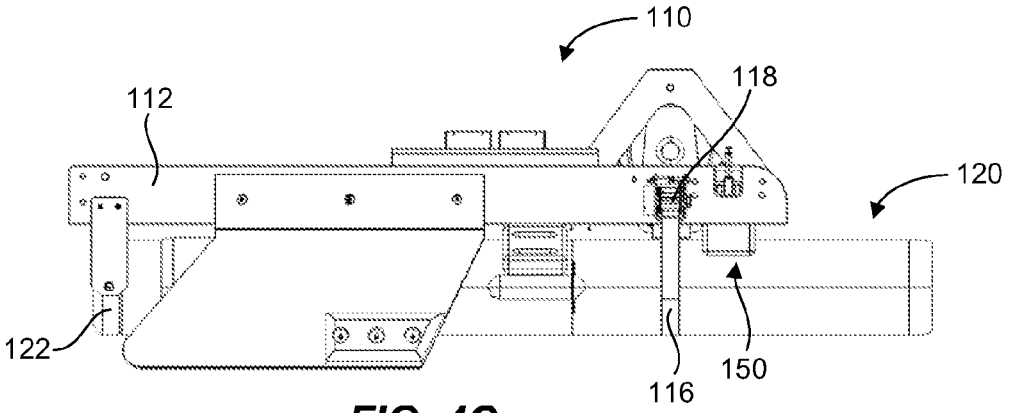
FIG. 4C is an opposite side view of the UUV launcher and attached UUV of FIG. 4B.

Upon release of the UUV 120 by the coupling device 114, a separation device 150 can be adapted to force the UUV 120 away from the launcher 110. The separation device 150 can be supported about the frame 112 and can comprise a pad 151 operable to interface with the UUV 120. For example, as illustrated in FIG. 3, the pad 151 can be curved to match a contour or radius of the hull 121 of the UUV 120. In one aspect, the pad 151 can be biased in a direction 152 away from the frame 112, such as by a spring. The UUV coupling device 114 and the separation device 150 can allow the launcher 110 and attached UUV 120 to enter the water together and separate in a controlled manner.

Figure 5:
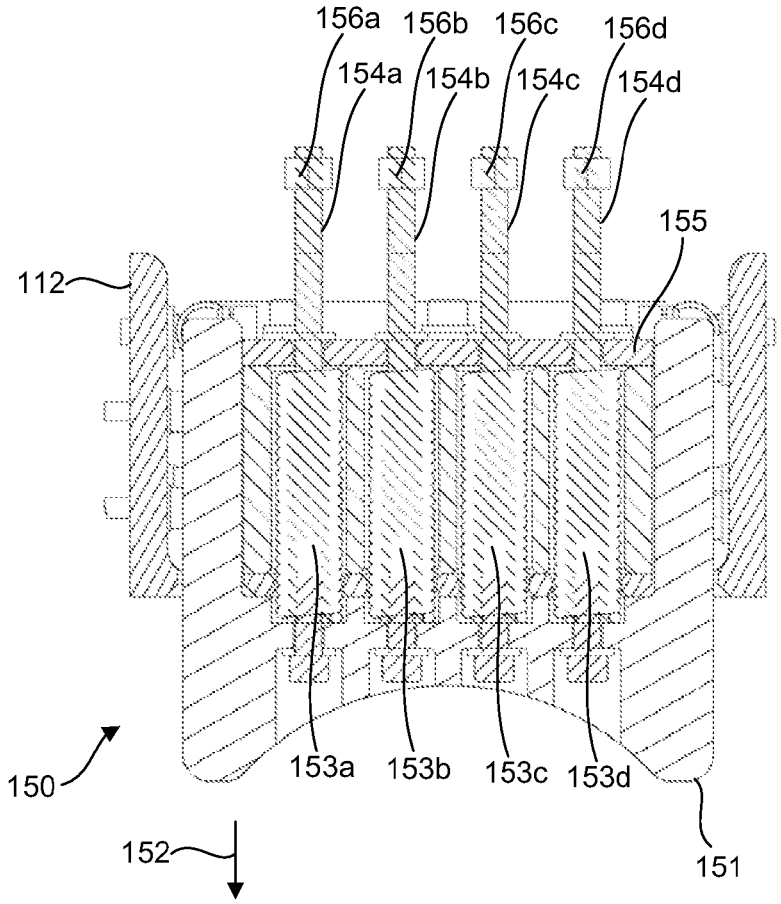
FIG. 5 is an example illustration of a separation device in accordance with an embodiment of the present invention.

As illustrated in FIG. 5, the separation device 150 can include springs 153*a*-*d* supported about rods 154*a*-*d* that extend through a backing plate 155. The springs 153*a*-*d* can be configured to exert a force on the backing plate 155 and the pad 151. The pad 151 can extend through the frame 112 and can be biased by the springs 153*a*-*d* to move in direction 152 away from the frame 112. The rods 154*a*-*d* can include stops 156*a*-*d* to limit movement of the pad 151 in direction 152. The springs 153*a*-*d* can be configured to exert at least enough force to cause separation of the UUV 120 from the launcher 110 while underwater.

Referring again to FIGS. 2 and 3, in one aspect, the launcher 110 can also be configured to arm a warhead of the UUV 120. For example, the UUV can include an arming pin 125 that must be removed prior to deployment of the warhead. The launcher 110 can include an arming pin engagement feature 160 supported about the frame 112. The arming pin engagement feature 160 can be operable to engage the arming pin 125 upon being secured to the launcher 110. In one aspect, the arming pin engagement feature 160 can include a slot 161 configured to capture a head of the arming pin 125. Thus, when the UUV 120 is separated from the launcher 110 by the separation device 150, the arming pin 125 can be removed from the UUV 120. This can facilitate automatic arming of the warhead that follows from deployment of the launcher 110 from the ship. This can also provide a safety benefit in that the warhead of the UUV 120 is not armed while the UUV is onboard the ship, but can instead be safely armed once a desired depth and/or distance from the ship is reached. However, it should be recognized that the arming pin 125 can be removed prior to coupling the UUV 120 to the launcher 110. If it is desired to pull the arming pin 125 upon separation of the UUV 120 from the launcher 110, the separation device 150 can be configured to exert an appropriate amount of force to cause separation of the UUV 120 from the launcher 110 while underwater as well as to pull the arming pin 125.

In one aspect, the UUV launcher 110 can also include a restraint 117 extending from the frame 112. The restraint 117 can be configured to interface with and support motor control arms 124*a*, 124*b* of the UUV 120. The motor control arms 124*a*, 124*b* can be configured to rotate between a stowage configuration next to a hull 121 of the UUV 120 and an operational configuration with the motor control arms 124*a*, 124*b* extended from the hull 121. The motor control arms 124*a*, 124*b* can be placed in the operational configuration when the UUV 120 is mounted to the launcher 110, such that the motor control arms 124*a*, 124*b* are deployed and ready for use when the UUV 120 enters the water. The restraint 117 can therefore be adapted to protect and/or maintain a correct orientation of the motor control arms 124*a*, 124*b* during deployment of the launcher 110 and attached UUV 120 into the water, such that the motor control arms 124*a*, 124*b* do not fold up into the stowage configuration due to the forces exerted on the motor control arms 124*a*, 124*b* upon entering the water.

The UUV launcher 110 can also include features configured to enhance stability of the launcher 110 in the water. In one aspect, the launcher 110 can include at least one fin 130*a*, 130*b* extending from a lateral side of the frame 112 to enhance stability of the launcher 110 in water. In another aspect, the launcher 110 can include a ballast member 131*a*, 131*b* disposed on the fin 130*a*, 130*b* to further enhance stability of the launcher 110 in water. In yet another aspect, the launcher 110 can include a floatation element 132 operable with the frame 112 to enhance stability of the launcher in water. The placement of ballast or other mass as well as the placement of floatation elements can position the center of buoyancy above the center of gravity to prevent rolling or inverting in the water. Any number of fins, ballast members, and floatation elements can be made operable with the launcher 110, and their location strategically placed in order to provide the most stable condition entering and within the water.

The launcher 110 can further include a swing arm 133 supported about the frame 112. The swing arm 133 can be pivotally coupled to the frame 112 at one or more pivot points 134 to facilitate rotation of the swing arm 133 about axis 135. (A second pivot point is obscured from view by the hydrostatic release latch 115 opposite pivot point 134.) The swing arm 133 can be configured to couple with a tether to facilitate tethering of the launcher 110 to the ship 103. This can enable retrieval of the launcher 110 following deployment and operation of the UUV 120.

In addition, the swing arm 133 can also facilitate back-tension braking of the launcher 110 upon deployment to counteract a hydrodynamic rolling effect of the launcher 110 away from the ship 103. Back tension braking can be accomplished by applying a force to a tether coupling the launcher 110 to the ship, which can slow movement of the launcher 110 through the water. In particular, the tether, such as a flexible rope or cable, can be coupled to the swing arm 133. When initially deploying the launcher 110, the tether can be slack to allow the launcher 110 and attached UUV 120 to free fall into the water. Back tension braking can be useful following deployment of the UUV 120 from the launcher 110 so that the launcher 110 does not "follow" the UUV 120 through the water. This can allow the UUV 120 to proceed away from the launcher 110 without interference from the launcher 110. Thus, tension can be applied to the tether at the appropriate point in the launch sequence to counteract the hydrodynamic rolling affect. In one aspect, the pivot point 134 of the swing arm 133 can be located on the frame 112 to cause the forward end 108 of the launcher 110 to rise upward in direction 136 in response to tension in the tether that can cause the forward end 108 to elevate relative to a rearward end 109 of the launcher 110.

As illustrated in the figure, the pivot point 134 is forwardly located on the frame 112. This can facilitate leveling of the launcher 110 in the water or even elevating the forward end 108 above the rearward end 109 of the launcher 110 by "swinging" the forward end 108 upward as the launcher 110 moves through the water. Such orientations can contribute to successful deployment of the UUV 120 by facilitating unhindered separation of the UUV 120 from the launcher 110. In one aspect, the buoyancy of the launcher 110 and/or rotating action of the swing arm 133 can be configured so that the UUV 120 is deployed while the launcher 110 is in a substantially horizontal orientation. In another aspect, hydrodynamics and the speed of descent through the water can achieve and/or maintain the launcher 110 at a correct orientation for separation of the UUV 120.

Figure 6:
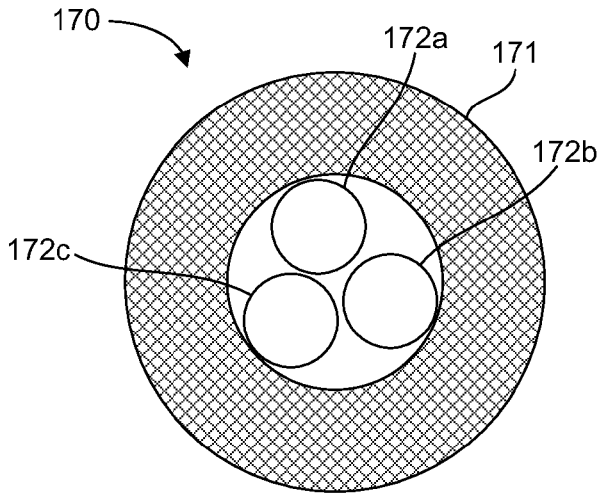
FIG. 6 is a cross-sectional view of a tether for a UUV launcher in accordance with an embodiment of the present invention.

FIG. 6 illustrates a cross-section of a tether 170 for coupling the launcher 110 to the ship. The tether 170 can include an outer sheath 171 and one or more communication lines 172*a-c*, such as fiber optic lines, associated with the sheath 171. Each of the communication lines 172*a-c* can comprise a single line or a bundle of lines. The sheath can be configured to shield the communication lines 172*a-c* from physical damage. For example, the sheath 171 can comprise a hollow core of braided material and the communication lines 172*a-c* can be disposed at a center of the hollow core. The sheath 171 can be configured to withstand axial loads placed on the tether 170 so that the communication lines 172*a-c* can remain substantially unstressed by the axial loads. In this way, the communication lines 172*a-c* can be protected from mechanical damage by being disposed inside the sheath 171 of the tether 170. Thus, the tether 170 can safeguard the communication lines 172*a-c* through launch, deployment and UUV mission life.

Referring again primarily to FIGS. 1 and 2, to prepare the UUV 120 for deployment, the launcher 110 can be engaged with the deployment device 102. The UUV can then be secured to the launcher 110, such that the canister 122 is coupled to the canister coupler 113*a*, 113*b* and the UUV coupling device 114 secures the hull 121 of the UUV 120. A tether can be coupled to the swing arm 133 and to the ship 103 in order to retrieve the launcher 110 following deployment. A communication line from the canister 122, which is connected to the UUV 120, can be attached to a communication line associated with the tether to facilitate remote control of the UUV from the ship. If automatic arming of a UUV warhead is desired upon separation of the UUV 120 from the launcher 110 in the water, the arming pin engagement feature 160 can be engaged with the arming pin 125.

The launcher 110 can be deployed by actuation of the triggering mechanism 105, which can allow the launcher 110 to slide down the rail 104, which can be directed away from the ship 103. Upon sliding off the end of the rail 104, the launcher 110 and attached UUV 120 can free fall into the water below.

Figures 7A, 7B, 7C, 7D:
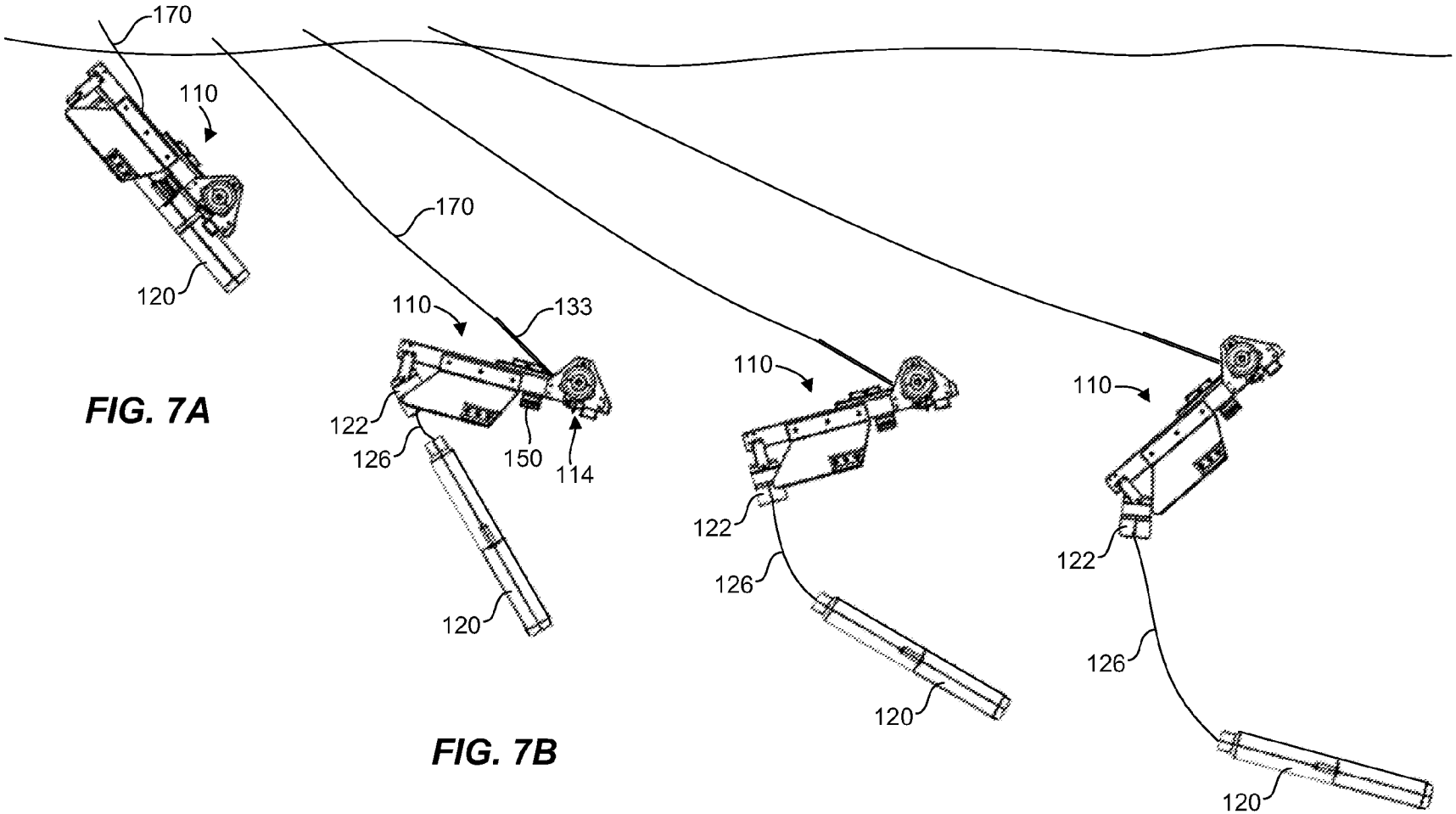
FIGS. 7A-7D are example illustrations of the UUV launcher and UUV deployed in a body of water in accordance with an embodiment of the present invention.

FIGS. 7A-7D illustrate the launcher 110 and UUV 120 upon entering the water. As shown in FIG. 7A, the launcher 110 and UUV 120 enter the water attached to one another with slack in the tether 170 to initially allow the launcher 110 and UUV 120 unrestricted movement through the water. As shown in FIG. 7B, upon reaching a predetermined depth, the UUV coupling device 114 can release the UUV 120 and the separation device 150 can force the UUV 120 away from the launcher 110. If applicable, the arming pin engagement feature can pull the arming pin as the UUV 120 is separated from the launcher 110. The tether 170 can also be pulled tight on the swing arm 133 to provide a back-tension brake to prevent the launcher 110 from hydrodynamically rolling away from the ship. As a safety benefit, the initial momentum of the UUV 120 into the water takes the UUV 120 away from the ship. In one aspect, the buoyancy of the launcher 110 can be configured so that the UUV 120 is deployed while the launcher 110 is in a substantially horizontal orientation. As shown in FIGS. 7B-7D, once separated, the deployed UUV 120 can move away from the launcher 110 to complete a mission objective, as remotely controlled from the ship. The canister 122 can rotate freely to a generally downward orientation as acted upon by the communication line 126 as the communication line 126 is paid out from the canister to follow the UUV 120 and facilitate remote control of the UUV 120. In one aspect, the buoyancy of the launcher 110 can be such that the launcher settles into a substantially horizontal or vertical orientation. Following completion of the mission, the launcher 110 can be retrieved via the tether 170 and reused.

Accordingly, in one embodiment of the present invention, a method of launching a UUV from a ship is disclosed. The method can comprise obtaining a UUV comprising a warhead and an arming pin. The method can also comprise supporting a UUV launcher about a deployment device operable to facilitate shipboard deployment of the UUV launcher. The method can further comprise supporting the UUV about the UUV launcher. The method can still further comprise strategically deploying the UUV launcher and the UUV into a body of water for subsequent separation and operation of the UUV. Additionally, the method can comprise separating the UUV from the UUV launcher. It is noted that no specific order is required in this method, though generally in one embodiment, these method steps can be carried out sequentially.

In one aspect, separating the UUV from the UUV launcher can cause the UUV launcher to remove the arming pin and arm the UUV. In another aspect, the method can further comprise braking the UUV launcher to counteract a hydrodynamic rolling effect of the launcher away from the ship.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. An unmanned underwater vehicle (UUV) launcher, comprising:

a frame;

a canister coupler to facilitate coupling of a communication line canister of a UUV to the launcher;

a UUV coupling device supported about the frame to releasably secure the UUV to the launcher;

an arming pin engagement feature supported about the frame, and operable to engage an arming pin of the UUV upon being secured to the launcher; and a separation device supported about the frame and adapted to force the UUV away from the UUV launcher upon release of the UUV by the UUV coupling device, wherein the arming pin is removed from the UUV upon separation.

2. The launcher of claim 1, further comprising an engagement member adapted to facilitate releasable coupling of the launcher to a deployment device.

3. The launcher of claim 1, wherein the separation device comprises a pad operable to interface with the UUV, wherein the pad is biased in a direction away from the frame.

4. The launcher of claim 3, wherein the pad is biased by a spring.

5. The launcher of claim 1, wherein the UUV coupling device comprises a hydrostatic release latch and a restraining strap selectively releasable by the hydrostatic release latch at a predetermined depth below a water surface.

6. The launcher of claim 1, further comprising a restraint extending from the frame, and adapted to maintain a correct orientation of a motor control arm of the UUV during deployment of the launcher.

7. The launcher of claim 1, further comprising at least one fin extending from a lateral side of the frame to enhance stability of the launcher in water.

8. The launcher of claim 7, further comprising a ballast member disposed on the at least one fin to further enhance stability of the launcher in water.

9. The launcher of claim 1, further comprising a floatation element operable with the frame to enhance stability of the launcher in water.

10. The launcher of claim 1, further comprising a swing arm supported about the frame to facilitate back-tension braking of the launcher upon deployment to counteract a hydrodynamic rolling effect of the launcher away from a ship, the swing arm facilitating tethering of the launcher to the ship.

11. An unmanned underwater vehicle (UUV) shipboard launcher system, comprising:

a UUV;

a UUV launcher in support of the UUV; and a deployment device disposed on a ship, and configured to facilitate shipboard deployment of the UUV launcher and the UUV, the UUV launcher being releasably engageable with the deployment device, wherein the launcher system strategically deploys the UUV launcher and the UUV into a body of water for subsequent separation and operation of the UUV, wherein the UUV launcher comprises:

a frame;

a canister coupler to facilitate coupling of a communication line canister of the UUV to the UUV launcher;

a UUV coupling device supported about the frame to releasably secure the UUV to the UUV launcher;

an arming pin engagement feature supported about the frame, and operable to engage an arming pin of the UUV upon being secured to the UUV launcher; and a separation device supported about the frame and adapted to force the UUV away from the UUV launcher upon release of the UUV by the UUV coupling device, wherein the arming pin is removed from the UUV upon separation.

12. The system of claim 11, wherein the UUV launcher comprises an engagement member.

13. The system of claim 12, wherein the deployment device further comprises a rail configured to receive and engage the engagement member of the UUV launcher, and wherein the UUV launcher is slideable along the rail and releasable from an end of the rail.

14. The system of claim 13, wherein the deployment device further comprises a support structure operable to support the rail about a deck of a ship.

15. The system of claim 14, wherein the frame is adjustable to alter at least one of a position and orientation of the rail.

16. The system of claim 14, wherein the frame is configured to be secured to a part of the ship.

17. The system of claim 13, wherein at least one of a position and orientation of the rail is adjustable.

18. The system of claim 11, further comprising a triggering mechanism to initiate deployment of the launcher from the deployment device.

19. The system of claim 11, further comprising a flexible tether coupling the UUV launcher to the ship.

20. The system of claim 19, wherein the tether comprises an outer sheath and a communication line associated with the sheath, such that the sheath shields the communication line from physical damage.

* * * * *